US006192655B1

(12) United States Patent
Todd et al.

(10) Patent No.: US 6,192,655 B1
(45) Date of Patent: Feb. 27, 2001

(54) HOSIERY MANIPULATION DEVICE AND METHOD

(75) Inventors: William H. Todd, Winston-Salem; Joseph L. Collins, Jr., Clemmons; Thomas A. Reavis, King; C. Michael Funderburk, East Bend; Clay A. Ferriola, Yadkinville, all of NC (US)

(73) Assignee: Todd Motion Controls, Inc., Winston Salem, NC (US)

( * ) Notice: Subject to any disclaimer, the term of this patent is extended or adjusted under 35 U.S.C. 154(b) by 0 days.

(21) Appl. No.: 09/386,616

(22) Filed: Aug. 31, 1999

(51) Int. Cl.[7] ..... B65B 35/50; B65B 35/56; B65B 13/00

(52) U.S. Cl. ..... 53/397; 53/413; 53/446; 53/447; 53/134.1; 53/540; 53/544; 53/580

(58) Field of Search ..... 53/413, 446, 447, 53/397, 134.1, 143, 540, 544, 581, 580

(56) References Cited

U.S. PATENT DOCUMENTS

| | | | | |
|---|---|---|---|---|
| 44,640 | * | 10/1864 | Lockwood . | |
| 1,192,519 | * | 7/1916 | Hammond . | |
| 2,078,448 | * | 4/1937 | Jost . | |
| 2,516,454 | * | 7/1950 | Doran . | |
| 2,612,737 | * | 10/1952 | Thielens | 53/540 |
| 3,469,364 | * | 9/1969 | Bischoff . | |
| 3,766,710 | * | 10/1973 | Goodwin et al. . | |
| 3,886,026 | * | 5/1975 | Kienel | 156/361 |
| 3,886,713 | * | 6/1975 | Mitchell et al. | 53/24 |
| 3,926,425 | * | 12/1975 | Pierce et al. | 270/83 |
| 3,954,543 | * | 5/1976 | Messmer | 156/363 |
| 3,960,276 | * | 6/1976 | Gerhardt | 214/1 BT |
| 4,018,031 | * | 4/1977 | Smaw | 53/159 |
| 4,235,161 | * | 11/1980 | Kunreuther | 227/28 |
| 4,292,786 | * | 10/1981 | Long et al. | 53/434 |
| 4,391,081 | * | 7/1983 | Kovacs | 53/436 |
| 4,419,088 | * | 12/1983 | Nemec | 493/444 |
| 4,481,751 | * | 11/1984 | Ujhelyi | 53/446 |
| 4,550,868 | * | 11/1985 | Hodges et al. | 223/43 |
| 4,564,133 | * | 1/1986 | Gazzarrini | 223/39 |
| 4,598,817 | * | 7/1986 | Bell, Jr. et al. | 198/468 |
| 4,643,705 | * | 2/1987 | Bober | 493/444 |
| 4,703,877 | * | 11/1987 | Kuniki et al. | 223/60 |
| 4,748,923 | * | 6/1988 | Walton et al. | 112/121 |
| 4,751,808 | * | 6/1988 | Hadden | 53/451 |
| 4,806,197 | * | 2/1989 | Harvey | 156/449 |
| 5,042,227 | * | 8/1991 | Merry | 53/438 |
| 5,169,376 | * | 12/1992 | Ries | 493/445 |
| 5,172,629 | * | 12/1992 | Merry | 100/35 |
| 5,188,696 | * | 2/1993 | Good, Jr. | 156/361 |
| 5,309,828 | * | 5/1994 | Merry | 100/35 |
| 5,353,576 | * | 10/1994 | Palamides et al. | 53/530 |
| 5,417,912 | * | 5/1995 | Merry | 264/320 |
| 5,682,734 | * | 11/1997 | Laster | 53/572 |
| 5,706,987 | * | 1/1998 | Todd et al. | 223/76 |
| 5,709,770 | * | 1/1998 | Asghar et al. | 156/447 |
| 5,788,130 | * | 8/1998 | Todd et al. | 223/37 |
| 5,996,320 | * | 12/1999 | Todd et al. | 53/526 |
| 6,042,674 | * | 3/2000 | Todd et al. | 156/229 |

FOREIGN PATENT DOCUMENTS

545446 * 5/1942 (GB) .

* cited by examiner

*Primary Examiner*—Linda Johnson

(57) ABSTRACT

A device to manipulate hosiery comprises a swift-tack apparatus joined to a j-hook magazine which selectively attaches a swift tack to a hosiery stack with or without a j-hook. The hosiery stack is then selectively inverted by a pair of rotatable clamps. The hosiery stack is then selectively rotated to a desired orientation by a turntable. The hosiery stack is then stacked with other hosiery stacks by means of a drop arrangement onto a lift plate. The combined stacks are then selectively attached one to the other by a second swift-tack apparatus. The above manipulations are effectuated preferably by pneumatic power and a plurality of pusher plates and lift plates.

12 Claims, 9 Drawing Sheets

HOSIERY MANIPULATION DEVICE AND METHOD

BACKGROUND OF THE INVENTION

1. Field of the Invention

This invention pertains to a device which is well suited to manipulate hosiery or other flexible items. Included manipulations are swift-tacking, j-hooking, inversion and rotation.

2. Description of The Prior Art And Objectives Of The Invention

In the hosiery industry, it is common to attach a j-hook to a hosiery stack with a length of plastic commonly referred to as a swif-ttack. Avery-Dennison makes a needle gun and swift-tack magazine device which effectively inserts the swift-tack via the needle into a hosiery stack. These are typically manual activities with an operator pushing a hosiery stack over the needle to insert the swift-tack. This is labor intensive and a fairly high risk activity as the operator may impale himself on the exposed needle while forcing the hosiery stack thereone. This be performed with or without a j-hook, but additional care and time must be used by the operator if a j-hook is being used to make sure that the swift-tack passes through the opening in the shank of the j-hook.

Long felt need within the hosiery industry has been the ability to manipulate the positioning of hosiery within a hosiery stack. For example, it may be desired to place three folded pairs of hosiery, head-to-toe-to-head, in a vertical stack, so that the middle pair is reversed relative to the outer two pairs. This is typically done manually and for appearance reasons. Additionally it may be desired to invert one or more pairs within the stack. Again, typically this is done manually and for appearance reasons.

Furthermore, after a hosiery stack is assembled, in whatever order is desired, it may be additionally desirable to insert an additional swift-tack into the complete stack for stabilization purposes in order to prevent a pair from flopping over while on a retail sales rack.

With the above concerns in mind, it is an objective of the present invention to provide a device which effectively automates a swift-tack and j-hook attachment to a pair of hosiery or other flexible item.

It is a further objective of the present invention to provide a device which can selectively invert a hosiery pair for eventual placement in a hosiery stack.

It is still a further objective of the present invention to provide a device which can selectively rotate a hosiery pair for eventual placement in a hosiery stack.

It is yet a further objective of the present invention to provide a device which includes two automated swift-tack insertion devices to effectuate proper inter-hosiery attachment.

It is another objective to provide a method of manipulating hosiery or other similar flexible items which includes swift-tacking, inversion and rotation.

These and other objectives and advantages will become readily apparent to those skilled in the art upon reference to the following detailed description and accompanying drawing figures.

SUMMARY OF THE INVENTION

The above objectives are realized by providing a device which incorporates an automated swift-tack apparatus with a magazine of j-hooks. As the hosiery stack, preferably a single folded pair, passes underneath the apparatus, the device selectively inserts a swift-tack with or without a j-hook as desired. The hosiery pair is then passed to a pair of clamps which selectively invert the hosiery pair as desired. From the clamps, the hosiery pair passes to a turn table which selectively rotates the hosiery pair to a desired orientation before passing the stack to a stacking area which stacks the hosiery pairs. Upon stacking a pre-selected number of hosiery pairs, the stack proceeds to a second swift-tack apparatus. The second swift-tack apparatus then selectively inserts a swift-tack through the entire stack before passing the assembled stack out of the device for further processing, such as banding or bagging.

Appropriate lift plates and pusher plates are used to move the hosiery about the device as needed. While mechanical, hydraulic or other means are possible to effectuate this movement, pneumatically controlled plates are used throughout the preferred embodiment.

Additionally, while the invention will be discussed in terms of hosiery, it is possible that the device may be used with many other flexible items such as towels, shirts or the like. Furthermore, while typically a single folded pair of hosiery will pass through and be operated upon by the device, it is possible that a plurality of pairs may be manipulated at the same time, but such is not preferred.

DETAILED DESCRIPTION OF THE PREFERRED EMBODIMENT AND OPERATION OF THE INVENTION

Figure 1:
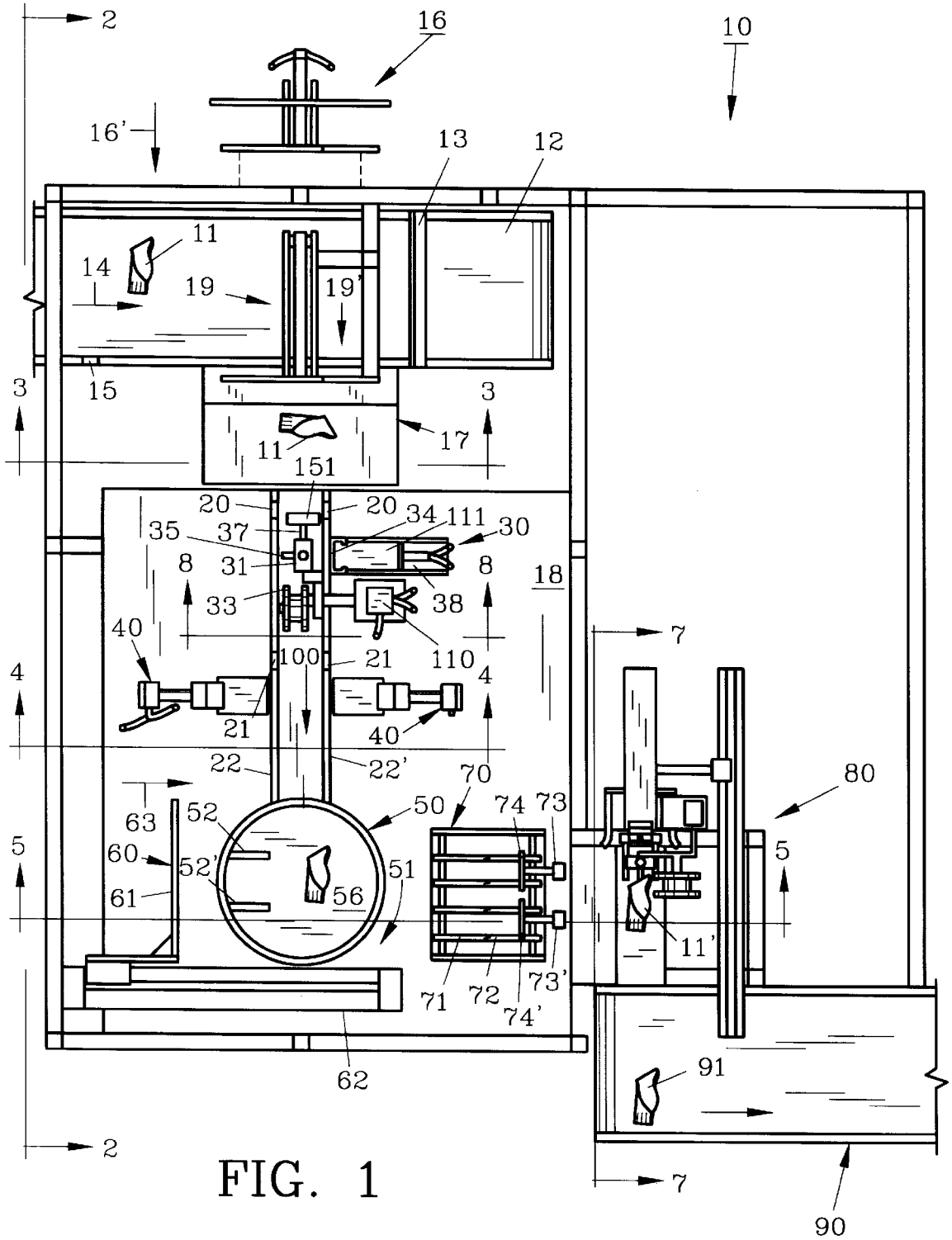
FIG. 1, shows a top down view of the device in its preferred embodiment.

Turning now to the drawings, specifically FIG. 1 shows a top down view of the preferred embodiment of hosiery manipulation device 10. Looking at FIGS. 1–3, hosiery 11 (FIG. 1), or other comparable flexible item enters conveyor 12 traveling for the purposes of this application laterally (left to right) as shown by arrow 14 (FIGS. 1 & 3). In the preferred embodiment, hosiery 11 is one folded pair of socks; it should be appreciated however, that hosiery 11 could comprise a plurality of folded hosiery pairs, a plurality of folded singles, or even a single sock, or other items, or clothing as desired by the user. Hosiery 11 encounters stop plate 13. Photoelectric eye 15 detects the passage of hosiery 11 and begins the cycling of device 10. Pneumatic pusher assembly 16 with one of pneumatic cylinder 151 and valve 142 (FIG. 9) pushes hosiery 11 longitudinally as indicated by arrow 16' from conveyor 12 onto pneumatic lift assembly 17, also with pneumatic cylinder 151 and valve 142. An unlabeled plate, shown in FIG. 1 spans the gap between conveyor 12 and lift assembly 17. Pneumatic assemblies, unless otherwise noted, generally comprise a plate which operates on the hosiery, pneumatic cylinder 151, valve 142, a pair of guide rods and suitable pneumatic connections (none labeled). This arrangement is well understood in the art and reference is made to U.S. Patent application PCT/US98/23607 for more complete details of similar mechanisms, which is herein incorporated by reference. It should also be understood that all pneumatic assemblies are in conventional parallel arrangement.

Figure 2:
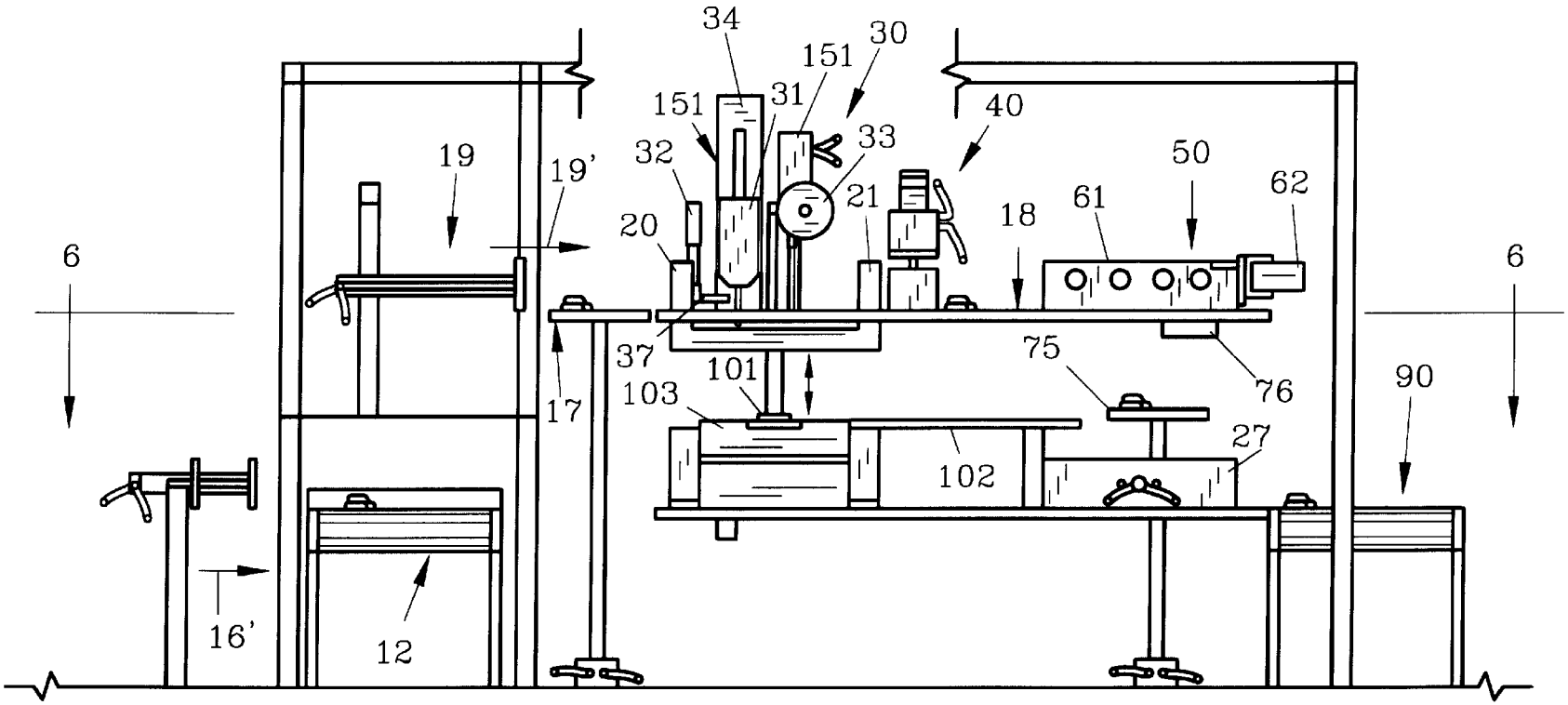
FIG. 2 ilustrates a side view of the device of FIG. 1.
Figure 3:
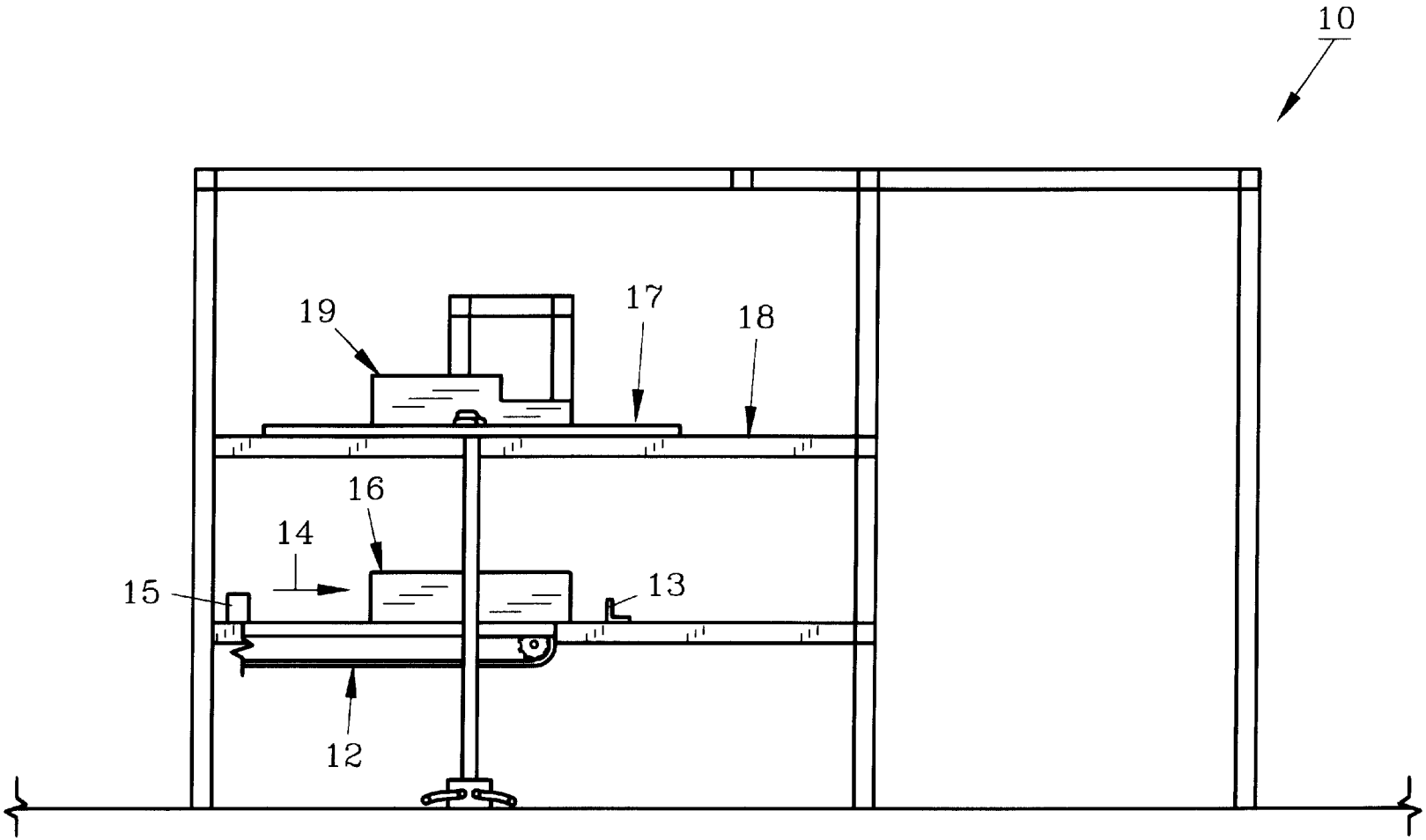
FIG. 3 demonstrates a partial cross-section along lines 3—3 of FIG. 1.

Lift assembly 17 (with a cylinder 151 and valve 142) raises hosiery 11 to deck 18 (FIGS. 1–3). Second pneumatic pusher assembly 19 (having a cylinder 151 and valve 141) pushes hosiery 11 longitudinally as indicated by arrow 19' (FIG. 1) from lift assembly 17 onto deck 18 where the true manipulations begin.

Figure 8:
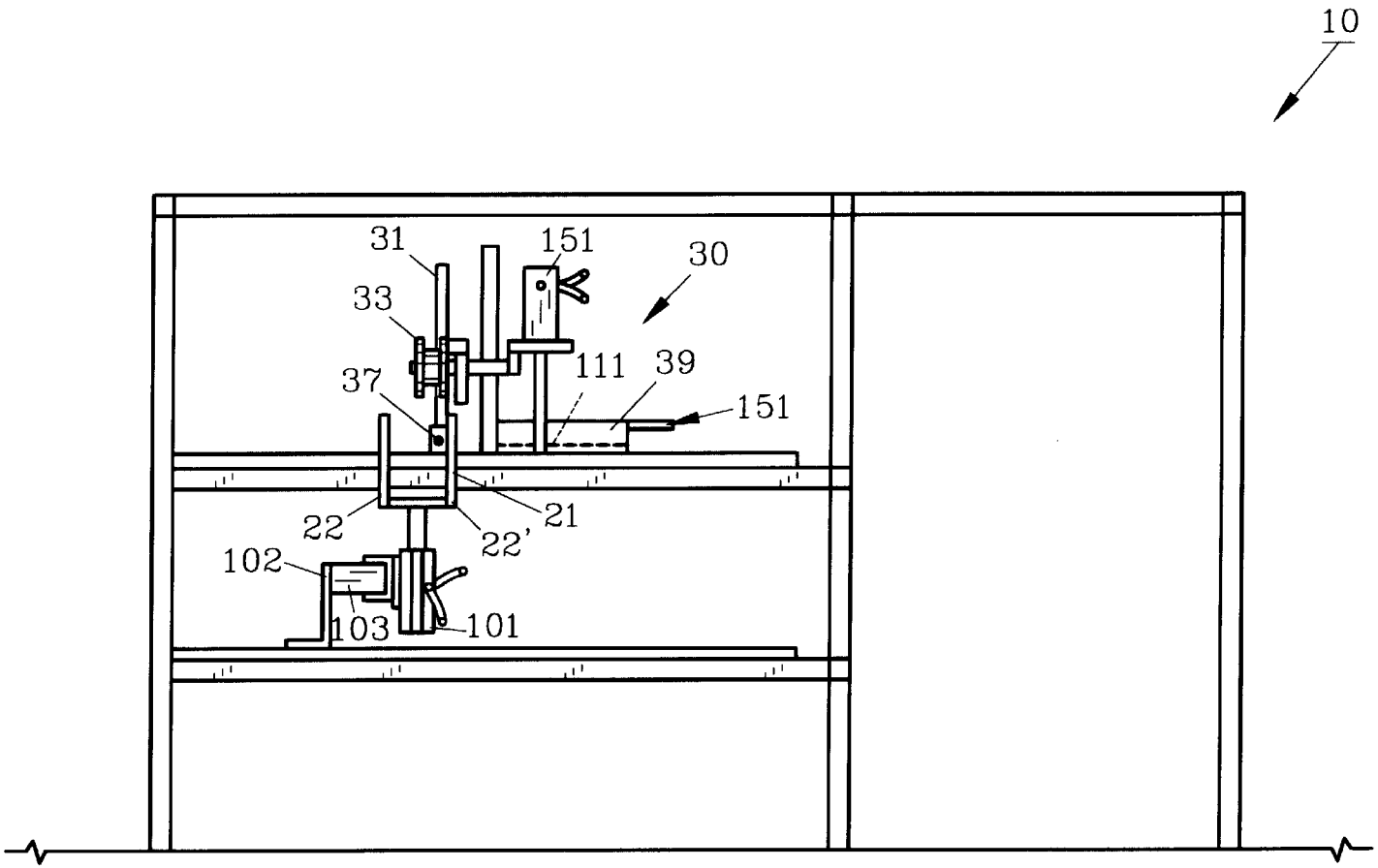
FIG. 8 illustrates a partial cross-section along lines 8—8 of FIG. 1.

Swift-tack apparatus 30, best seen in FIGS. 1, 2 and 8 comprises conventional swift-tack needle gun 31 such as that sold by AveryDennison under the name SWIFTACH. This device inserts a needle through a hosiery stack and inserts a swift-tack stored in swift-tack magazine 33. Conventionally, the hosiery stack is pressed down by a cylinder 151 and valve 142 onto the needle to effectuate this insertion. In the present invention, clamp 37, moved by pneumatic cylinder 151, holds hosiery 11 in place while a second pneumatic cylinder 151 lowers swift-tack tack needle gun 31 and magazine 33 into hosiery 11. The needle is actuated pneumatically and the swift-tack is then inserted into hosiery 11. The gun needle passes into slot 35 to insure proper insertion of the swift-tack through hosiery 11. Swift-tack needle gun 31 and magazine 33 are then raised and clamp 37 raised, allowing fingers 20 or 21 to move hosiery 11 to clamp assemblies 40. Two Hall-effect sensors 132 (FIG. 9) are used to sense the movement and insertion of the needle into the hosiery and two Hall-effect sensors 132 are used to monitor the position of brass plate 111.

Proximate swift-tack apparatus 30 is j-hook hopper 34, which works in conjunction with swift-tack apparatus 30 to attach a j-hook to hosiery 11. J-hook hopper 34 receives a conventional stack of j-hooks there within, with a slidable weight (not shown) positioned atop said stack of j-hooks. Pneumatic cylinder 151 pushes brass plate 111 within housing 39 to shear the bottom j-hook off the stack within hopper 34 and extends outwardly to the path of needle gun 31. The tip of the needle inserts the swift-tack through the hole of the j-hook shank and continues insertion of the swift-tack into hosiery 11, thereby attaching a j-hook to hosiery 11 if so desired. It should be understood that it is entirely optional whether or not to insert a swift-tack or attach a j-hook. The j-hook cannot be attached without the swift-tack, but not every hosiery must receive a swift-tack or both. In this manner hosiery stacks may be created which meet the designs of the operators.

Figure 5:
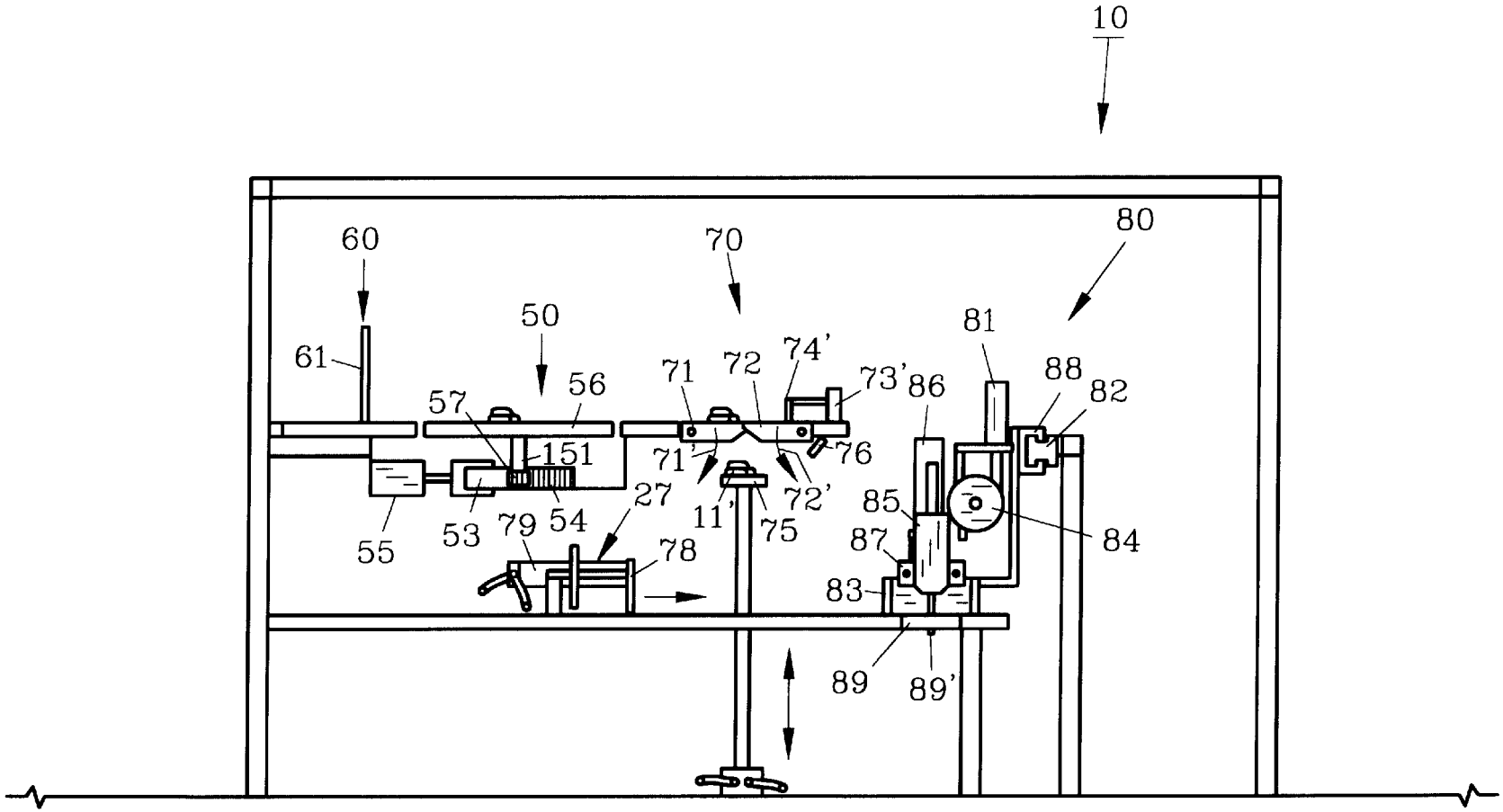
FIG. 5 pictures a partial cross section along lines 5—5 of FIG. 1.

Turntable assembly 50 which utilizes cylinder pair 154 (FIG. 9) is best seen in FIGS. 1 and 5. Fingers 21 may slide into slots 52, 52' when turntable top 56 is in its default position (not shown). As will be explained below, turntable assembly 50 rotates as generally indicated by arrow 51 (FIG. 1) to move hosiery 11 in a desired manner. At the very least, hosiery 11 will be rotated 90° degrees, but it may selectively be rotated 270° degrees in order to reverse hosiery 11 relative to other hosiery within the eventual hosiery stack.

Pusher plate assembly 60, having a cylinder 151 with valve 142, is best seen in FIGS. 1, 2 and 5 pushes rotated hosiery 11 from turntable 50 laterally as indicated by arrow 63 onto stacking assembly 70. Push plate 61 rides on pneumatic track 62 to effectuate this movement.

Figure 6:
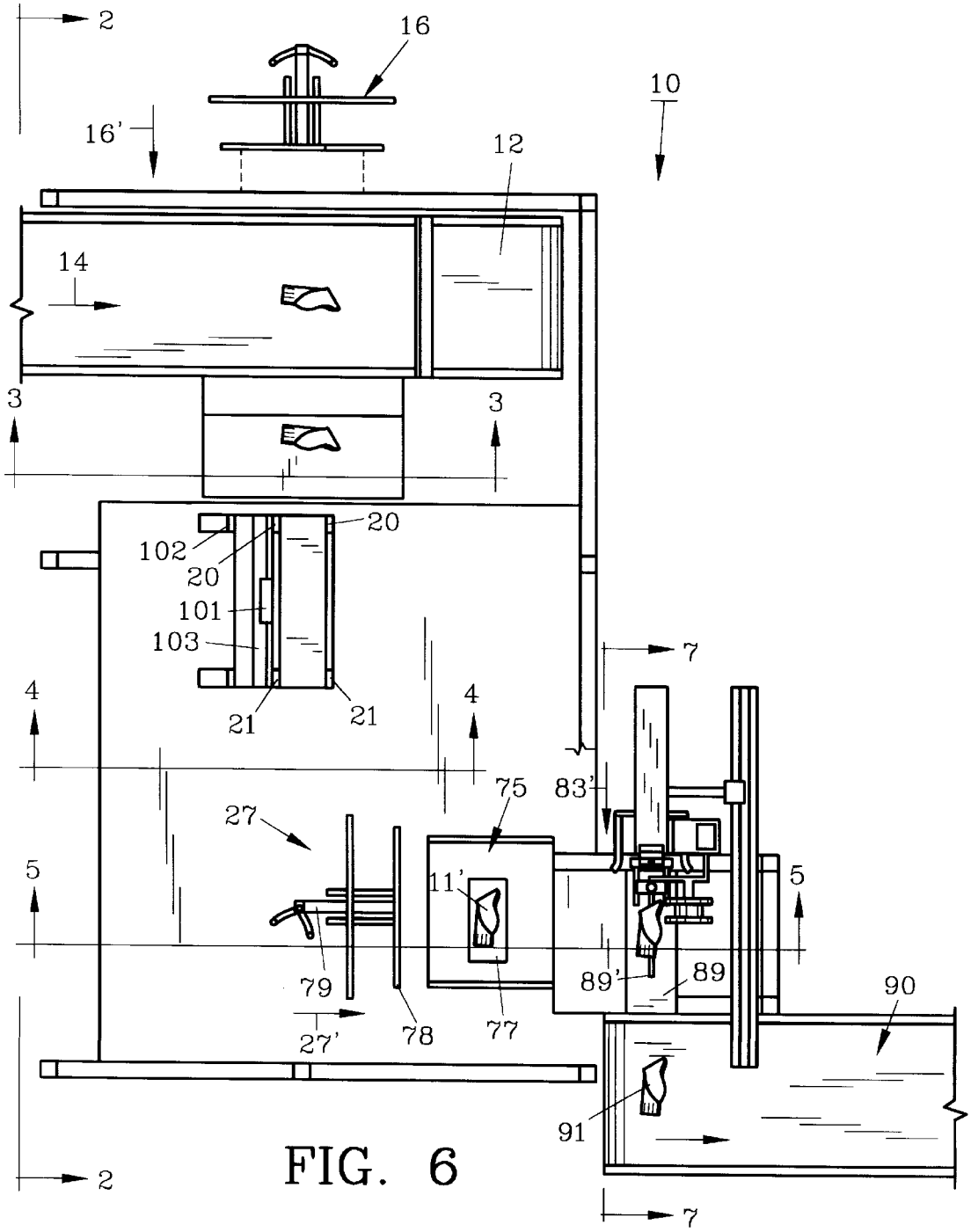
FIG. 6 depicts a partial cross-section along lines 6—6 of FIG. 2.

Stacking assembly 70, best seen in FIGS. 1, 5 and 6, comprises pivotable finger arrays 71 and 72 which interlock to form a stable, smooth surface onto which hosiery 11 is pushed by pusher plate assembly 60. Posts 74, 74' are attached to deck 18 by posts 73, 73' respectively and prevent hosiery 11 from being pushed to far. After positioning on finger arrays 71 and 72, lift plate 75 (FIGS. 5 and 6) is raised with cylinder 151 and valve 142 to a height as determined by electric eye 76. The purpose of eye 76 is to insure that each hosiery 11 falls the same amount onto plate 77 of lift assembly 75 with cylinder 151 and valve 142. For the first hosiery 11, plate 77 is lifted until the top surface breaks the plane of eye 76's vision. For second and subsequent hosiery 11, eye 76 detects the top surface of the topmost piece of hosiery and arrests the movement of plate 77. In this manner, hosiery 11 falls the same amount of distance regardless of the size of hosiery stack 11'. Hosiery 11 falls when finger arrays 71 and 72 pivot downwardly as indicated by arrows 71' and 72' respectively (FIG. 5).

As seen in FIGS. 2, 5 and 6, pusher plate assembly 27 with cylinder 151 and valve 142, and specifically plate 78 of assembly 27 pushes hosiery stack 11' laterally as indicated by arrow 27' towards second swift-tack apparatus 80. Plate 78 is driven by pneumatic assembly 79, also with cylinder 151 and valve 142, as is well understood.

Figure 4:
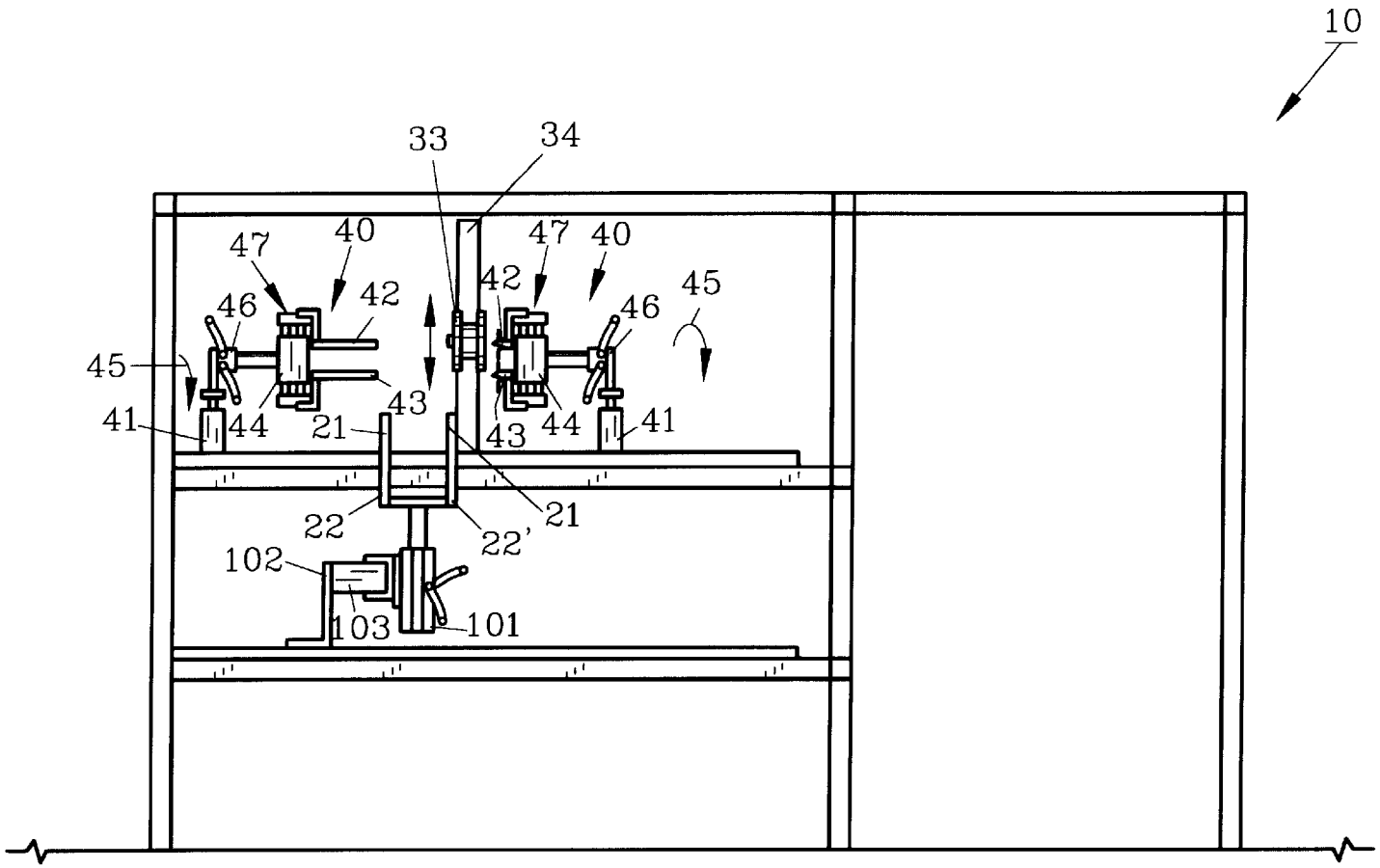
FIG. 4 features a partial cross-section along lines 4—4 of FIG. 1.

Turning now to FIGS. 1, 2 and 4, fingers 20 and 21 arise through slotted tracks 22 and 22' by means of second lift pneumatic 101 (FIG. 2) utilizing pneumatic cylinder 151 and valve 142 and push hosiery 11 longitudinally as indicated by arrow 100 (FIG. 1) from first swift-tack apparatus 30.

As seen in FIGS. 2 and 4, second lift pneumatic 101 rides on track 102 and is pneumatically propelled thereon by pneumatic assembly 103 having a pneumatic cylinder 151 with valve 142. In operation, fingers 20 arise proximate lift assembly 17 and push hosiery 11 from swift-tack apparatus 30, lower while swift-tack apparatus 30 performs its manipulations, raise again, and push hosiery 11 to clamp assemblies 40. If desired, fingers 20 lower while clamp assemblies 40 invert hosiery 11. After inversion, or continuously if no inversion is desired, fingers 21 raise and push hosiery 11 to turntable assembly 50.

Returning to FIG. 4, clamp assemblies 40 are now explained. Three pneumatic devices control each clamp assembly 40. Specifically, pneumatic 41 utilizing cylinders 151 and valves 142 raise and lower assemblies 40; pneumatic 44 also utilizing cylinders 151 and valves 142 open and close jaws 42 and 43; and pneumatic 46 utilizing rotary actuators 152 rotate jaw assemblies 47 as generally indicated by arrow 45. Initially, the upper surface of lower jaws 43 is flush with deck 18, and hosiery 11 is moved onto said upper surface by fingers 20 (FIG. 1). If inversion of this particular hosiery 11 is desired, pneumatic 44 utilizing cylinder pairs 153 (FIG. 9) closes upper jaws 42 against lower jaws 43 thereby sandwiching hosiery 11 therebetween. Pneumatic 41 utilizing cylinder pairs 153' (FIG. 9) raises jaw assemblies 47 above the plane of deck 18 and then pneumatic 46 rotates 180 degrees effectively to flip hosiery 11. Pneumatic 41 through cylinder pairs 153' then lowers jaw assemblies 47 and fingers 21 push hosiery 11 to turntable assembly 50.

Turning now to FIG. 5, turntable assembly 50 is explained in more detail. Pneumatic 55 utilizing cylinder 151 and valve 142 drives linear actuator 53 with gear ridges 54. Gear ridges 54 mesh with gear 57 on the end of cylinder 151, which is rigidly affixed to the center of turntable top 56. As pneumatic 55 drives linear actuator 53 in and out, ridges 54 force gear 57 to turn, thereby turning turntable top 56. In this manner, hosiery 11 may be rotated 90° or 270° degrees as desired to make ultimate hosiery stack 11' be head-to-head-to-head; head-to-toe-to-head or any other desired arrangement.

Figure 7:
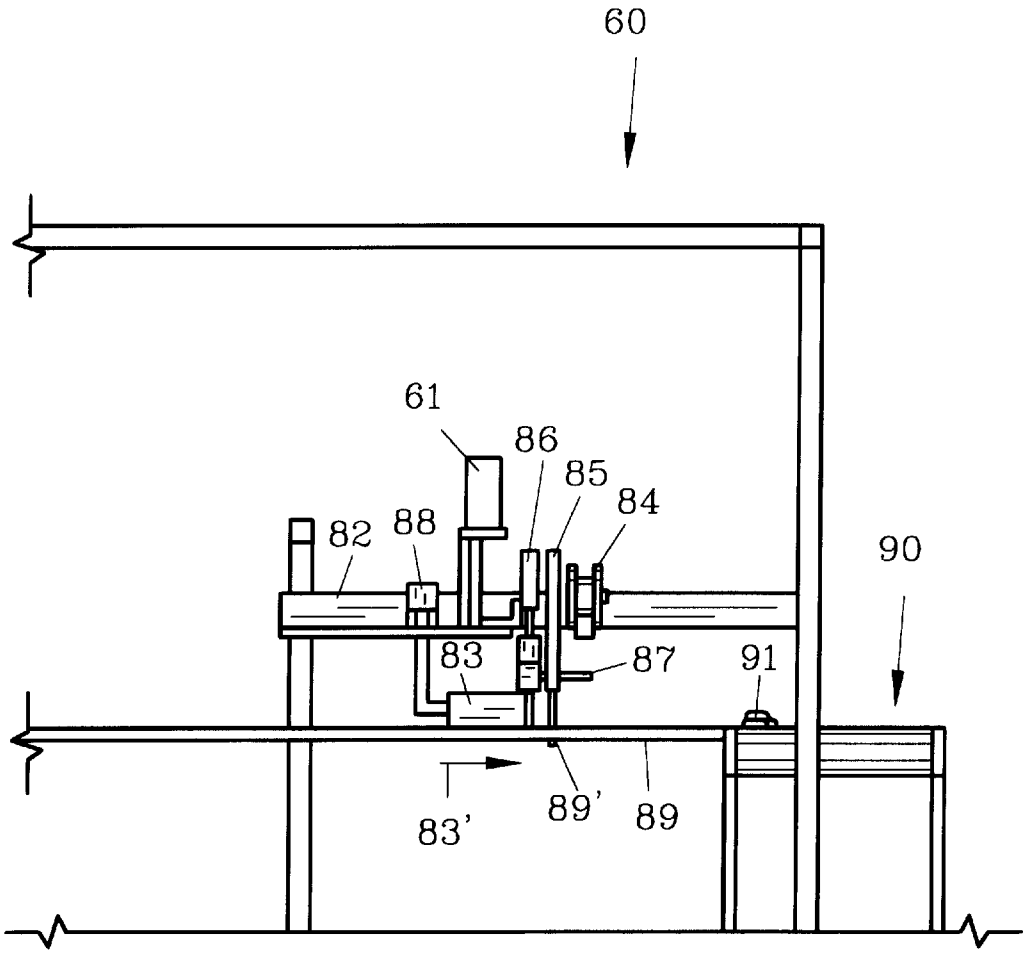
FIG. 7 shows a partial cross-section along lines 7—7 of FIG. 1.

Second swift-tack apparatus 80, seen best in FIGS. 5–7, is slightly different than first swift-tack apparatus 30. After plate 78 moves hosiery stack 11' onto slotted plate 89 (FIG. 5), two fingered clamp 87 is lowered by pneumatic 86 having cylinder 151 and valve 142 to compress hosiery stack 11' and hold it in position. After clamping, pneumatic 81 lowers swift-tack needle gun 85 and swift-tack circular magazine 84 and inserts a swift-tack into hosiery stack 11'. It should be understood that the needle extends through slot 89' (FIG. 6) of slotted plate 89. Needle gun 85 is raised as is two fingered clamp 87, and u-shaped pusher plate 83 is moved longitudinally as generally indicated by arrow 83' along pneumatic track 82 by slide 88 until finished hosiery stack 91 reaches conveyor 90 for further processing.

Figure 9:
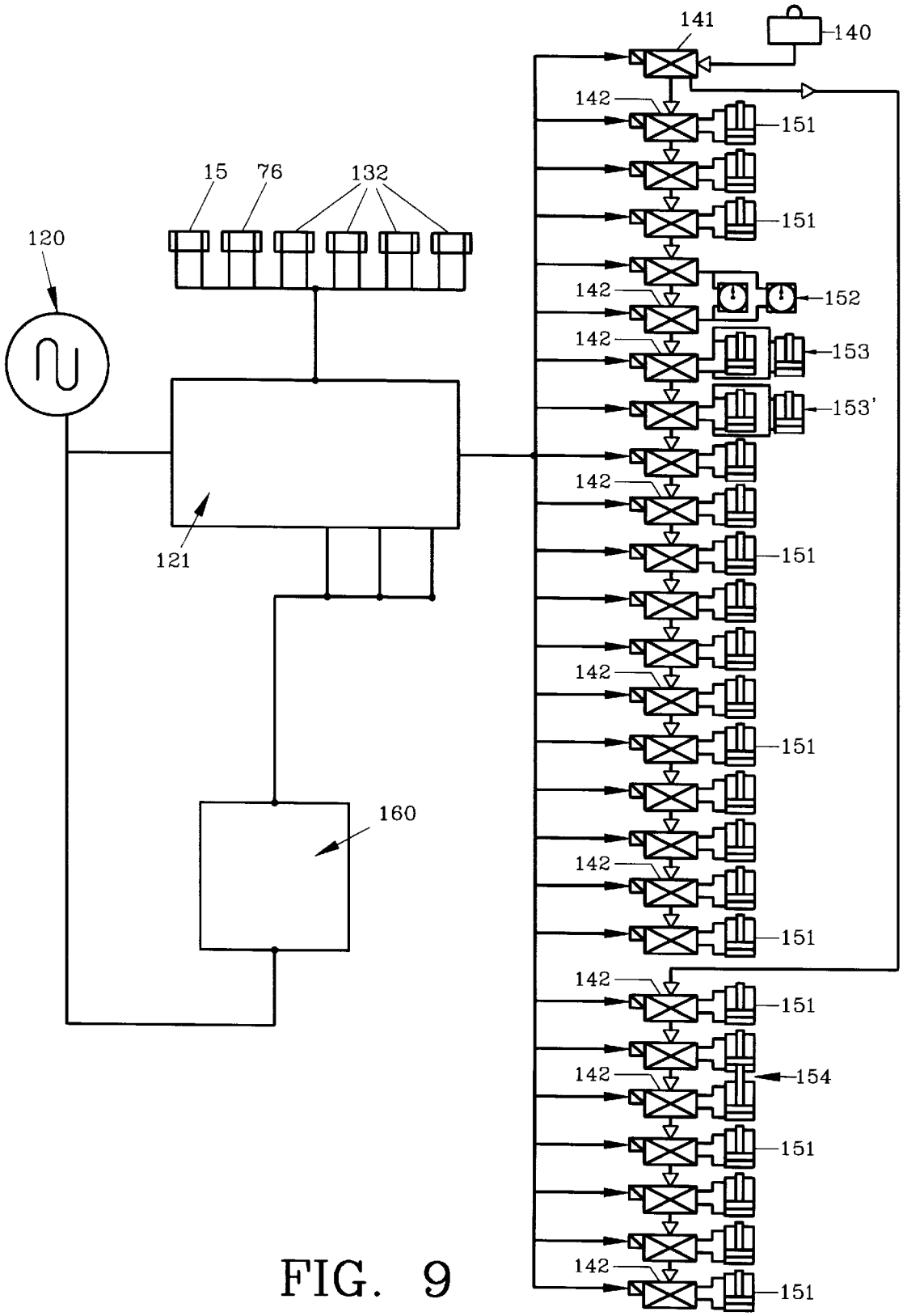
FIG. 9 demonstrates a combined electrical and pneumatic schematic diagram of the invention.

In FIG. 9, single phase 220 V. A.C. is received from power source 120. Programmable logic circuit (PLC) 121, specifically that sold under the name Direct Logic 205 is coupled with a DL240 CPU and two D2-16ND3-2 input modules along with two TD2-2 output modules positioned in one of its three slots. These components are commercially available and well understood and used in the industry. PLC 121 receives 24 V. D.C. current from D.C. current supply 160. PLC 121 also drives photoelectric sensors 15,76 and Hall-effect sensors 132. Standard electro/pneumatic valves 142 also receive current from PLC 121 for operation of associated pneumatic cylinders and devices.

Pneumatic source 140, such as a standard air compressor or otherwise supplies air to master soft-start/dump valve 141 which regulates the air flow to parallel pneumatic circuits (for example, represented by valves 142 with cylinders 151 which are standard pneumatic cylinders). Pneumatic 152 is a conventional rotary actuator for clamp 37. Cylinder pair 154 are mechanically connected in conjunction with each other to operate turntable assembly 50 as hereinbefore described.

The preceding recitation is provided as an example of the preferred embodiment and is not meant to limit the nature of scope of the present invention or appended claims.

We claim:

1. A device for manipulating hosiery, said device comprising:

a) a frame;

b) a swift-tack apparatus, said swift-tack apparatus attached to said frame;

c) a clamp, said clamp attached to said frame, said clamp for selectively inverting a workpiece; and d) a turntable, said turntable attached to said frame, said turntable for selectively rotating the workpiece.

2. The device of claim 1 further comprising a j-hook magazine, said j-hook magazine attached to said frame proximate said swift-tack apparatus.

3. The device of claim 2 further comprising a plurality of j-hooks, said j-hooks positioned within said j-hook magazine, said j-hooks selectively fed from said magazine for attachment to the workpiece by said swift-tack apparatus.

4. The device of claim 1 wherein said swift-tack apparatus selectively inserts a swift-tack into the workpiece.

5. The device of claim 1 further comprising a second swift-tack apparatus, said second swift-tack apparatus attached to said frame.

6. The device of claim 1 further comprising a stacking plate, said stacking plate attached to said frame proximate said turntable.

7. A method of manipulating a flexible item, said method comprising the steps of:

a) selectively attaching a swift-tack to the workpiece;

b) selectively inverting the workpiece;

c) selectively rotating the inverted workpiece to a desired orientation; and d) thereafter stacking a plurality of workpieces.

8. The method of claim 7 further comprising the step of selectively attaching a j-hook to the workpiece.

9. The method of claim 7 further comprising the step of selectively attaching a second swift-tack to the stacked plurality of workpieces.

10. The method of claim 7 wherein inverting the workpiece comprises the step of using a clamp to invert the workpiece.

11. The method of claim 7 wherein selectively rotating the workpiece to a desired orientation comprises the step of using a turntable to rotate the workpiece to a desired orientation.

12. The method of claim 8 further comprising the step of selectively feeding a j-hook from a j-hook magazine prior to selectively attaching a j-hook to the workpiece.

* * * * *